United States Patent [19]

Starrett

[11] 4,203,599

[45] May 20, 1980

[54] POLICE STICK

[75] Inventor: Paul D. Starrett, Rindge, N.H.

[73] Assignee: Monadnock Lifetime Products, Inc., Fitzwilliam, N.H.

[21] Appl. No.: 913,891

[22] Filed: Jun. 8, 1978

[51] Int. Cl.[2] ..... F41B 15/02

[52] U.S. Cl. ..... 273/84 R

[58] Field of Search ..... 84/477 B; 273/67 R, 273/68, 72 A, 73 R, 73 C, 73 H, 82 A, 84 R

[56] References Cited

U.S. PATENT DOCUMENTS

| | | | |
|---|---|---|---|
| D. 230,150 | 1/1974 | Anderson | 273/84 R X |
| 1,567,659 | 12/1925 | Lawrence | 273/84 R X |
| 1,950,342 | 3/1934 | Meshel | 273/72 A X |
| 2,988,949 | 6/1961 | Rohnmann | 84/477 B |
| 3,633,910 | 1/1972 | Spenle | 273/73 C X |
| 3,727,295 | 4/1973 | Gildemeister | 273/72 A X |
| 3,729,196 | 4/1973 | Heald | 273/72 A |
| 3,854,316 | 12/1974 | Wilson | 273/72 A X |

FOREIGN PATENT DOCUMENTS

| | | | |
|---|---|---|---|
| 726578 | 1/1966 | Canada | 273/68 |
| 741710 | 12/1932 | France | 273/68 |
| 923293 | 7/1947 | France | 273/68 |
| 1287775 | 2/1962 | France | 273/84 R |

*Primary Examiner*—Richard J. Apley

*Attorney, Agent, or Firm*—Robert T. Gammons

[57] ABSTRACT

A police stick comprising an elongate metal tube closed at its opposite ends and filled with a cellulose polystyrene and a rigid handle fixed to the tube nearer one end than the other such as to divide the stick into a short portion which, in conjunction with a handle, facilitates manipulation of the stick and a long portion at the other side by means of which the execution of the maneuver is accomplished.

3 Claims, 5 Drawing Figures

POLICE STICK

BACKGROUND OF INVENTION

In my U.S. Pat. No. Des. 230,150. there is shown a police stick of the configuration of that of this invention which is made of a solid stick of extruded plastic. The plastic stick will warp in hot climates and will shatter in cold climates. Nevertheless, it has been widely accepted because the use of a plastic stick is generally considered more humane and less brutal than a hardwood or metal stick and because it has proved unexpectedly successful both in the protection of the lawman and the execution of his duties with minimal injury to the recipient. It is the purpose of this invention to provide a police stick of the aforesaid kind which will be as acceptable as that referred to without its disadvantages.

SUMMARY OF INVENTION

In its preferred form, the police stick comprises an elongate rigid metal tube closed at its opposite ends and filled with a vibration-absorbent material such as porous or cellular polyurethane or its equivalent or a natural material such as cork. A handle is fastened to the tube at right angles thereto closer to one end than the other so that the shorter portion at the one side enables controlling the stick and the longer portion at the other side enables execution of the maneuver. The stick has a 1.250 inch outside diameter, a wall thickness of 0.120 inches and is comprised of an aluminum titanium alloy. The overall weight is approximately 27 ounces and the overall length approximately 23 inches. Alternatively, the vibration-absorbent material may be omitted.

In the preferred form, the stick is made by cutting a length of metal tube corresponding to the length of the stick to be made, internally threading its ends, filling it with a vibration-absorbent material, capping the opposite ends and attaching a handle of extruded plastic to it nearer one end than the other. The tube may be filled with a premolded foam plastic or other cellular material such as cork forced into the tube. Preferably, the tube is filled by pouring a liquid mixture of the ingredients into the tube which, upon activation, will combine to form a porous vibration-absorbent structure. The preferred material is a polyurethane foam.

The invention will now be described in greater detail with reference to the accompanying drawings, wherein.

Figure 1:
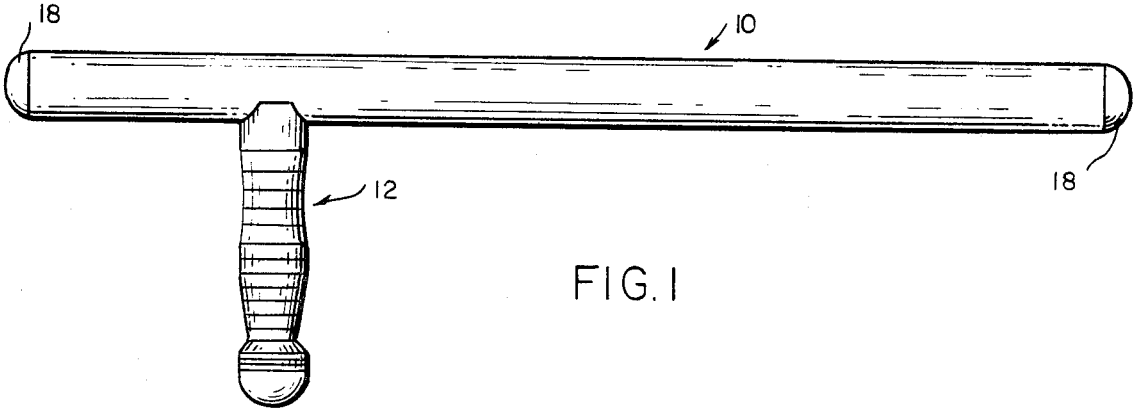
FIG. 1 is an elevation of the police stick.

Referring to the drawings, FIG. 1, the police stick of this invention comprises a rigid elongate member 10 to which there is fastened intermediate its ends and nearer one end than the other at right angles to the axis of the member 10 a handle 12.

Figure 2:
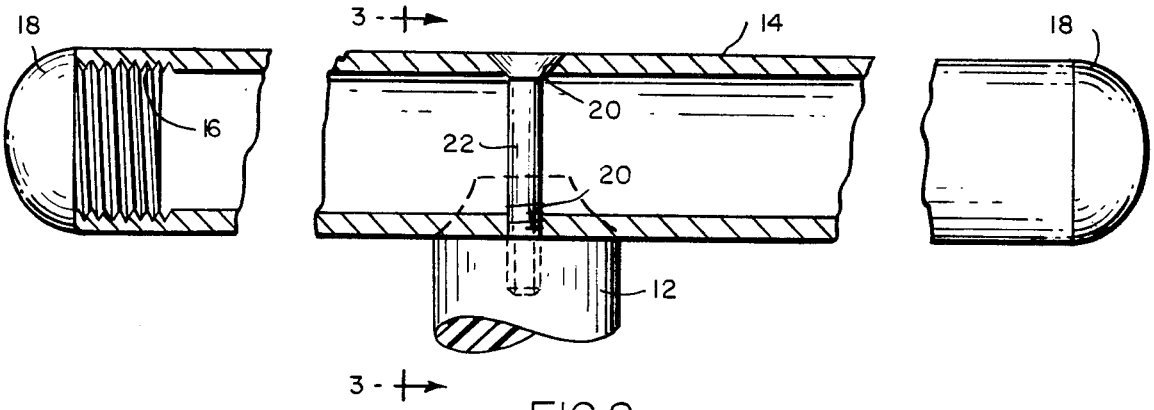
FIG. 2 is a longitudinal section broken away in part to much larger scale of one form of the police stick.
Figure 3:
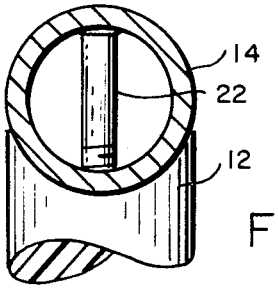
FIG. 3 is a section taken on the line 3—3 of FIG. 2.

In accordance with the invention in one form, the elongate rigid member 10 is a metal tube 14, FIG. 2, of suitable length threaded internally at 16 at both ends for receiving closure caps 18 and provided with diametrically-disposed openings 20—20 for receiving a bolt 22 which is screwed into the handle 12.

The metal tube 14 has an outside diameter of 1.250 inches, a wall thickness of 0.120 inches and is comprised of an alloy of aluminum, specifically a No. 6061-T6 aluminum titanium alloy. The overall length is approximately 23 inches.

The caps 18 at the ends are semispheral and made of plastic and threaded so as to be screwed into the threaded ends of the tube.

The handle 12 is an extruded plastic saddle shaped at one end to receive the cylindrical surface of the tube to which it is attached and surface-embossed throughout its length to provide a good grip for handling the stick.

A suitable non-glare finish may be applied to the metal tube as, for example, by anodizing the surface and thereafter polishing the anodized surface to a smoothness corresponding to that of the surface of the extruded plastic of the handle. The total weight of the structure is approximately 27 ounces.

The police stick as thus made provides protection not only for the officer using the same, but for the recipient, in that it can be wielded both as a defensive and an offensive implement, is light enough in weight so that it can be manipulated easily and, when blows are inflicted, will not have the impact of a solid metal stick, but will have substantially the same impact potential as the plastic stick referred to above.

Figure 5:
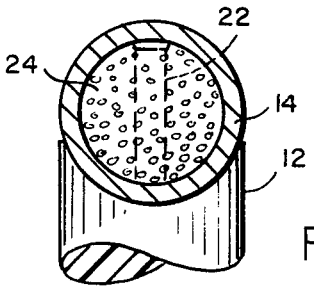
FIG. 5 is a section taken on the line 5—5 of FIG. 6.
Figure 4:
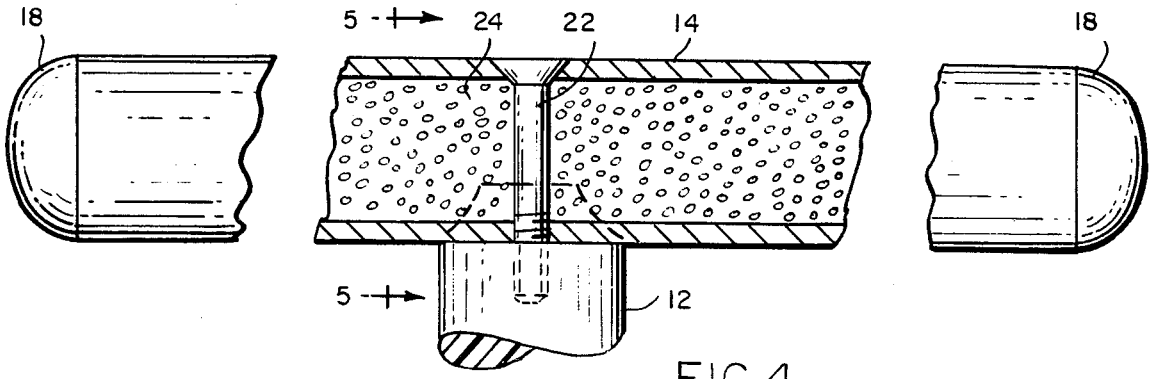
FIG. 4 is a longitudinal section of an alternative form of the invention.

The one disadvantage that the hollow stick has is that the vibration of a blow either taken by the officer from an assailant or a blow delivered by the officer, for example, to break a window or a door for the purpose of gaining access, is transmitted through the stick to the hand, wrist and arm of the officer and, in many instances, is of such severity as to temporarily render the hand incapable of holding the stick, thus causing the officer to drop it. This disadvantage is nullified as disclosed in FIGS. 4 and 5 by filling the hollow tube 14 with a vibration-absorbent material 24. The preferred vibration-absorbent material 24 is a cellular resinous plastic, for example, foamed polyurethane or its equivalent. The material used is Chempol 32-1761/32-1601, a mixture of urethane foam resin and isocynate, a product of Freeman Chemical Corporation. The preferred way of filling the tube is to close one end of the tube with one of the caps 18 and then to pour into the other end a mixture of the ingredients necessary, when activated, to form a foam within the tube which completely fills it.

Optionally, a preformed core piece of foamed polyurethane could be made and forced into the tube or a stick of cork.

The filling of vibration-absorbent material, since it is of a porous or cellular nature, adds very little weight to the structure, affords some additional strength and, to a large extent, reduces the noise of impact.

It should be understood that the present disclosure is for the purpose of illustration only and includes all modifications or improvements which fall within the scope of the appended claims.

I claim:

1. A police stick comprising a hollow, elongate metal tube of uniform circular cross section containing at its ends internal threading, said tube being comprised of an aluminum alloy of alluminum and titanium and having a wall thickness of approximately 0.120 inches, and hemispherical end caps corresponding in diameter to the diameter of the tube provided with threaded neck portions for screwing the caps into the threaded ends of the tube, said caps being comprised of solid, rigid plastic, a body of vibration-absorbent, cellular, resinous plastic material such as foamed polyurethane completely filling the tube so as to have intimate interfacial contact with the interior surface of the tube from end to end, said tube containing diametrically-aligned holes, a handle comprised of a solid, rigid plastic containing at one end a diametrically-disposed, concave, arcuate recess corresponding in radius of curvature to the radius of curvature of the tube and of such depth that, when disposed at right angles to the tube, its concave ends extend more than a quarter of the way around the tube, but less than half the way around, said concave end containing an internally threaded axial hole and a screw bolt extending through the diametrically-aligned holes into the threaded hole in the handle fixing the handle to the tube, said handle when fixed to the tube being located nearer one end than the other so as to divide the tube into a short length at one side of the handle which, in conjunction with the handle, provides means for manipulation of the stick and a longer length at the other side by means of which the execution of a maneuver may be accomplished and said handle having at its distal end a hemispherical knob and between the knob and the affixed end, a grip-enhancing surface.

2. The method of making a police stick comprising providing a length of metal tube, threading the opposite ends interiorly to receive threaded closure caps, filling the tube with a mixture of ingredients which when activated will form a body of foam within the tube to completely fill the same, screwing a threaded cap into the opposite end and securing a rigid handle to the tube at right angles to the axis thereof prior to filling the tube with a foam-producing material.

3. The method of making a police stick comprising providing a length of metal tube of an alloy of aluminum and titanium having an outside diameter of 1.250 inches and a wall thickness of 0.120 inches, driving a preformed stick of cellular material of a diameter corresponding substantially to the inside diameter of the tube and of a length corresponding substantially in length of the tube into the tube, screwing closure caps into the opposite ends of the tube and fastening a handle to the tube intermediate the ends at right angles to the axis thereof.

* * * * *